US005645199A

United States Patent [19]

Schnitzler

[11] Patent Number: 5,645,199

[45] Date of Patent: Jul. 8, 1997

[54] FOAM GUN TIP ASSEMBLY

[76] Inventor: Paul J. Schnitzler, 11802 Sherman St., Northglenn, Colo. 80233

[21] Appl. No.: 378,280

[22] Filed: Jan. 26, 1995

[51] Int. Cl.[6] ..... B67D 5/00

[52] U.S. Cl. ..... 222/567

[58] Field of Search ..... 239/600, 526, 239/583, 584; 222/145.1, 145.5, 145.7, 526, 530, 538, 567, 568

[56] References Cited

U.S. PATENT DOCUMENTS

| | | | |
|---|---|---|---|
| 1,566,597 | 12/1925 | Harman | 222/538 X |
| 2,635,010 | 4/1953 | Sanders et al. | 239/526 X |
| 3,174,660 | 3/1965 | Bundy | 222/559 X |
| 3,409,044 | 11/1968 | Sobek | 137/607 |
| 3,722,762 | 3/1973 | Mann | 222/568 |
| 3,814,329 | 6/1974 | Clark | 239/526 X |
| 3,952,927 | 4/1976 | Schaumberg et al. | 222/559 X |
| 4,083,474 | 4/1978 | Waite | 222/145.7 |
| 4,550,863 | 11/1985 | Farrey | 222/145 |
| 4,991,750 | 2/1991 | Moral | 222/567 X |
| 5,027,975 | 7/1991 | Keske | 222/1 |
| 5,348,230 | 9/1994 | Mullen | 239/428 |
| 5,407,106 | 4/1995 | Jens | 222/504 |

FOREIGN PATENT DOCUMENTS

| | | | |
|---|---|---|---|
| 843934 | 7/1949 | Germany | 222/530 |

OTHER PUBLICATIONS

Handi–Foam® One–Component Convertible Dispensing Gun–Operating Instructions, Fomo Products Inc., 2775 Barber Road , P.O. Box 1078, Norton, Ohio 44203 (1993).

*Primary Examiner*—Andres Kashnikow
*Assistant Examiner*—Kenneth Bomberg
*Attorney, Agent, or Firm*—Dorr, Carson, Sloan & Birney, P.C.

[57] ABSTRACT

A foam gun tip assembly capable of quickly mounting various kinds of foam-dispensing tubes.

14 Claims, 5 Drawing Sheets

10
28'
34
30
18
32'
38
32
20
16
22

28
24
26
22
22
26
12
14
12'

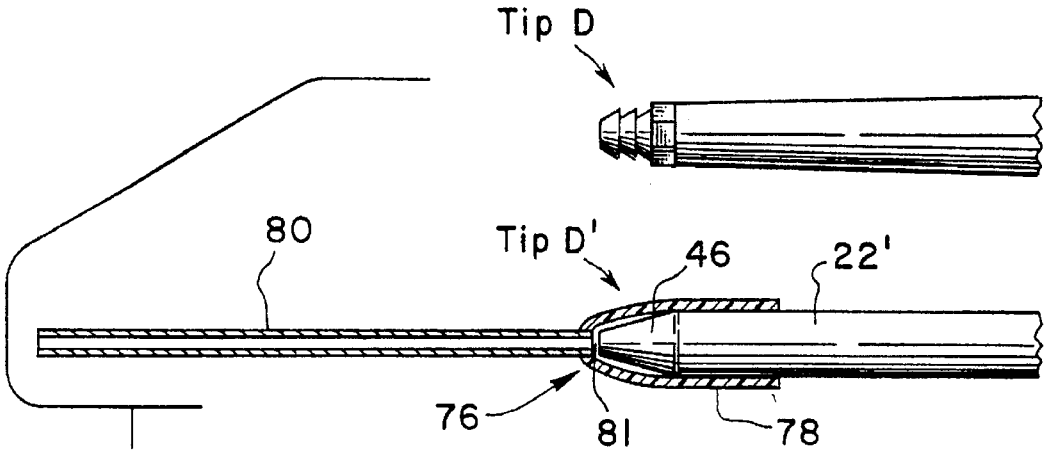
Fig. 5
(Prior Art)
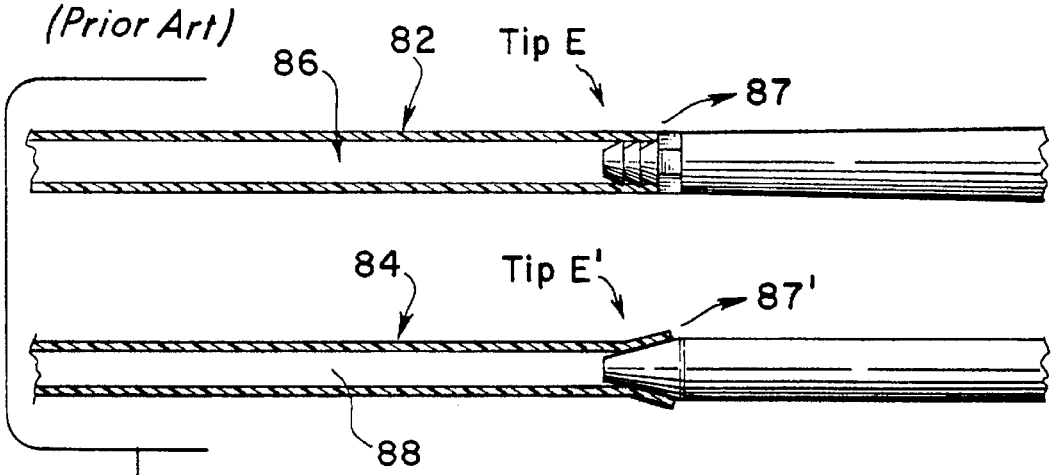
Fig. 6
(Prior Art)
Fig. 7(a)
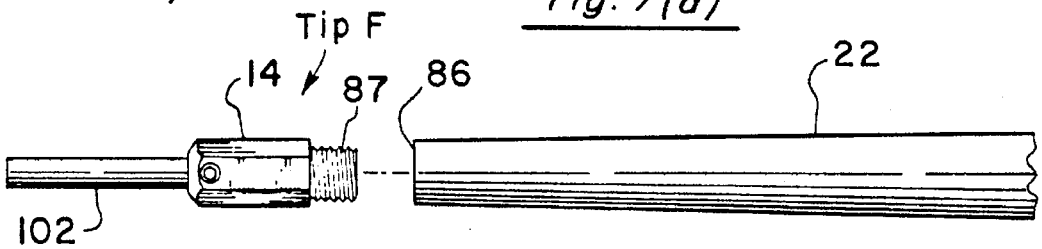
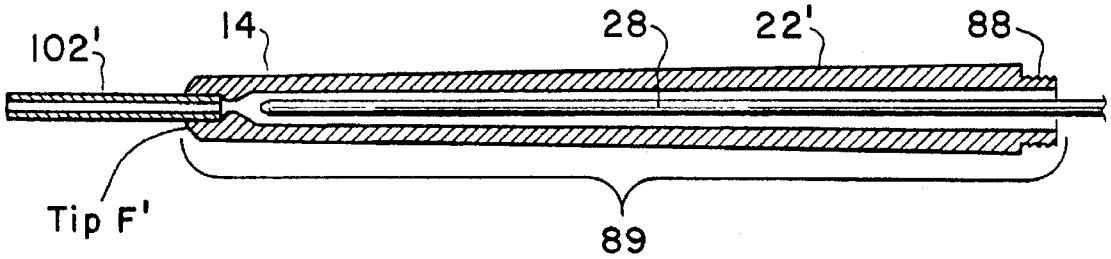
Fig. 7(b)

FOAM GUN TIP ASSEMBLY

BACKGROUND OF THE INVENTION

Hand held, foam guns are used to deliver beads, filets, globs, etc. of foam (e.g., polyurethane foams) that—upon curing—serve to seal cracks, holes and other openings through which undesired fluids would otherwise pass. For example, polyurethane foams are widely used in building construction to seal cracks against outside air and water leakage—as well as against insect invasion. Some foam guns dispense ready-made foams while others are designed to mix foam-making ingredients in the gun and then dispense the resulting foam product out of the gun's nozzle (see for example U.S. Pat. No. 4,550,863).

In many prior art foam application practices, foams (ready-made foams, provided in pressurized containers, as well as foams formulated in a foam gun just before it is dispensed) are dispensed through hose(s) carrying foam (or foam-making ingredients) from such containers to hand held applicator devices. These applicator devices often employed a ball valve, positioned near the applicator's outlet, to control the foam's flow at the applicator's dispensing nozzle. One of the chief drawbacks to this mode of foam application was the fact that there was a significant delay between the time the ball valve was turned off, and the time the foam actually stopped being dispensed from the applicator's nozzle. That is to say that, even after the ball valve completely stopped flow of the foam into the applicator, the foam beyond the shut off valve would auto-expand in the applicator and be forced out of its dispensing nozzle.

This continued foam flow is often referred to as "post-shutoff-drip." Post-shutoff-drip in such prior art devices often dispenses an additional 4 to 8 inch bead of foam after the shutoff valve is fully closed. At the very least, post-shutoff-drip wastes valuable foam; worse yet, the "excess" foam often overfills cracks and/or holes to such an extent that undesired humps or bulges of cured foam are created. These humps or bulges of cured foam often cause subsequent construction problems and/or conflicts between tradesman. For example, such humps may cause drywall that is laid over such humps of cured foam to bulge outward and make the drywall installer's job more difficult and less workmanlike. This very undesired effect is addressed in two ways: by labor intensive (and hence expensive) hand removal of such humps or bulges of cured foam and/or increased care and skill on the part of the foam gun operator.

Such care and skill implies that the operator learn to "anticipate" where a moving hand held applicator device will completely cease dispensing foam and learn to close the dispensing valve before the foam bead reaches its anticipated end point. If the operator stops the foam flow too soon, the crack, gap or other opening may not be completely filled. This may result in undesired fluid or insect invasion via that opening. To prevent this, the operator must perform a second caulking operation to correct his mistake. Such corrections waste the operator's valuable time. Conversely, if the operator stops the foam flow too late, waste—and, perhaps, undesired humps of cured foam—will result. Long periods of trial and error type experience are needed before most operators acquire the "knack" for such anticipatory valve shut off operations.

In response to this post-shutoff-drip problem, a new generation of hand held applicator devices was developed in the 1980's. These devices had a pistol-like design and were provided with a needle valve rod that seated, and thus shut off foam flow, at, or very near to, the foam gun's dispensing nozzle. This design feature made the operator's release of the trigger (to stop the foam's flow) much more contemporaneous with the actual shut off of the foam's flow. This desirable feature is often referred to as "positive-shutoff". In effect, this positive-shutoff follows from the fact that the gun's foam shut off valve is made a integral part of its dispensing nozzle. In effect, this arrangement places the valve's choke point within less than about a quarter inch of the nozzle's front tip. This results in minimal post-shutoff-drip (e.g., it is generally less than about one half inch using foam guns of this type).

Unfortunately, achievement of this ability to minimize post-shutoff-drip, introduced a new set of problems and aggravations. Not the least of these is the fact that these positive-shutoff nozzle tips are worn down very quickly as they are dragged across hard, rough surfaces such as concrete floors and walls. Such wear not only destroys the outer surface of the nozzle, it soon reaches the needle valve rod itself; and damage to these rods—and hence the valving action controlled by them—all too soon, leads to costly repairs and a great deal of expensive "down time" for such foam guns, and "lost time" for their operators.

Another problem with these positive-shutoff foam guns follows from the fact that their needle valve-containing nozzle ends are positioned so close to the gun barrel conveying the foam that the barrel's diameter (as opposed to the nozzle's generally "thinner" diameter) defines the width of the cracks, holes, etc. into which the nozzle tip can be inserted. For example, it is hard, or impossible, to get a gun's nozzle three or four inches deep into a one quarter inch wide crack, hole, etc. if the diameter of the barrel of the gun immediately behind the nozzle has an outside diameter of one half inch. Some manufacturers tried to solve this "too large of a barrel diameter" problem by tapering the nozzle end of the barrel to a diameter just slightly larger than the nozzle's diameter. Unfortunately, this tapered barrel approach tends to slow down foam flow to such an extent that there is a substantial increase in application time using foam guns having tapered barrels. This increases labor costs. Furthermore, these positive-shutoff foam guns tend to produce foam beads whose surfaces (or "skins") are of a lesser quality than prior art hand held applicator devices.

In response to these nozzle "accessibility," time loss and bead quality problems, a wide variety of "accessory tips" were developed. Most of these were especially adapted to dispense foam into gaps that are more narrow than a foam gun's barrel near its foam dispensing end. Unfortunately, problems and aggravations also arose with use of such accessory tips. By way of example, many of these accessory tips were designed to merely slide over the barrel and nozzle in a, not particularly tight, compression fit. Consequently, such accessory tips often slip off the end of the nozzle or gun barrel on which they are mounted when normal foam application pressures are applied and/or when the accessory tip is dragged across rough surfaces. Other kinds of prior art accessory tips tend to stay in place on the end of such guns; but, continue to have problems with foam leakage at their connection points with the gun barrel. Moreover, truly effective use of many prior art accessory tips often becomes a "two-handed" operation: that is to say that one hand is needed to hold the gun at its pistol grip and operates the trigger—while the fingers of the other hand hold the accessory tip firmly in place on the end of the gun barrel and/or accurately guide the accessory tip into cracks, holes, etc. Generally speaking, such two-handed operations are more tiring than one-handed operations. Two-handed operations also tend to introduce greater safety hazards into many work situations since foam gun operators often have to work from stepladders. Moreover, many of these accessory tips have, to a large degree, re-introduced the post-shutoff-drip problem. This follows from the fact that these accessory tips often have relatively large volumes; hence, they too continue to dispense their foam contents after the gun's shutoff valve is completely closed.

SUMMARY OF THE INVENTION

This invention provides a foam gun tip assembly that can be quickly adapted to perform a wide variety of caulking jobs—as they are encountered by the foam gun operator. For example, in new house construction practices: (1) a 4" standard end tip (i.e., one having a circularly—configured end) is needed to shoot to the back of high quality wood windows, (2) a 1¼" standard end tip is needed to seal small gaps in framing in order to seal in and around various fastener penetrations, (3) a 8" standard end tip is often needed to fit up and into tight areas at mud sills and (4) a 1¼" caulking tip (one whose front end is cut on a biased angle) is often needed to seal the plates where a building's walls meet its floor. Furthermore, the versatility of applicant's foam gun tip assembly can be achieved with: minimal post-shutoff-drip, shorter operator training time, greater ease of operation of the foam gun to which the hereindescribed foam gun tip assemblies are attached and greater ease of cleaning the nozzle—and indeed the entire gun—after use. The hereindescribed foam gun tip assemblies also are characterized by the fact that they can be mass-produced using commercially available stock materials (e.g., hexagonal, steel bar stock and round, copper tubing). Consequently, applicant's foam gun tip assemblies can be provided at such low cost that they can, "less begrudgingly," be treated as "disposable items" after use—especially in those often-occurring instances where they are quickly worn down by dragging them across hard rough surfaces such as concrete.

In general, the foam dispensing guns to which applicant's foam gun tip assemblies are to be attached have a pistol-like body having: (1) an upper barrel component having a longitudinal bore through which foam such as polyurethane passes from a foam container (that is usually mounted on the barrel of such guns) to a foam-dispensing nozzle, (2) a pistol grip mounted under the barrel and (3) a trigger mechanism mounted below the barrel and in front of the pistol grip. The front end of the barrel of many such foam guns is adapted to carry a replaceable dispensing nozzle—and, very importantly, applicant's foam gun tip assemblies can be readily mounted in place of such nozzles.

The inside rear wall of the barrel of such foam guns also has an opening positioned coaxial with the "bore" of the gun's barrel for passing a reciprocally movable needle valve rod through virtually the entire length of such guns. The trigger mechanism also is connected, by a linkage system, to the needle valve rod. This needle valve rod extends through a hole in the rear end of the gun barrel, through the entire length of the barrel, all the way to the gun's nozzle.

Such prior art foam-dispensing nozzles also serve as the gun's shutoff valve by virtue of the fact that the front end of the needle valve rod is slidably mounted in a shutoff valve chamber in the body of the nozzle. Pulling the gun's trigger backward, toward the pistol grip, causes the needle valve rod to be pulled out of the nozzle's shutoff valve chamber so that foam in the barrel's bore is forced, (by pressure provided by the foam container), through the nozzle's shutoff valve chamber and dispensed from its tip. The front end of the needle valve rod acts as the gun's foam flow "valve" because its outer diameter coincides with the inner diameter of the shutoff valve chamber of the nozzle. Conversely, when the foam gun's trigger is released, the needle valve rod is biased forward by a spring mechanism located in a rear portion of the gun's body. In effect, forcing the needle valve rod forward closes the shutoff valve chamber to the flow of the foam.

In many foam gun designs, the needle valve rod has its rear end projecting through an opening in the rear of the gun barrel—where it is connected to the trigger by the linkage mechanism. In many foam gun designs, the end of the needle valve rod also engages with a foam flow adjustment screw as well as the trigger linkage mechanism. Finally, it should be noted that even though most foam guns of this kind have their foam supply canister positioned on top of their barrel, there are some guns that are fed from the bottom by a hose leading from a foam supply container that is not directly mounted to the gun. In either case, however, the foam supply is connected to a port in the gun's body that leads to the barrel. Again, the foam gun tip assemblies of this patent disclosure can be readily used with such prior art foam guns—or they can be incorporated into guns especially adapted to employ applicant's foam gun tip assemblies.

BRIEF DESCRIPTION OF THE DRAWINGS

FIG. 1(*a*) also suggests the manner in which a foam gun tip assembly of this patent disclosure can be similarly associated with such a prior art foam gun.

FIG. 5 depicts one of the two gun barrel ends shown in FIG. 2 provided with another commonly used accessory tip.

FIG. 6 shows the two gun barrel ends of FIG. 2 provided with yet another kind of accessory tip.

FIG. 7(*b*) is a cut-away view of a foam gun tip assembly having the housing and foam gun conduit barrel component made into a unitary piece. FIG. 7(*c*) is a cut-away view of a foam gun tip assembly having the foam gun tip, the housing and the foam gun conduit barrel component made in a unitary piece.

DETAILED DESCRIPTION OF THE INVENTION

Figures 1, 1A:
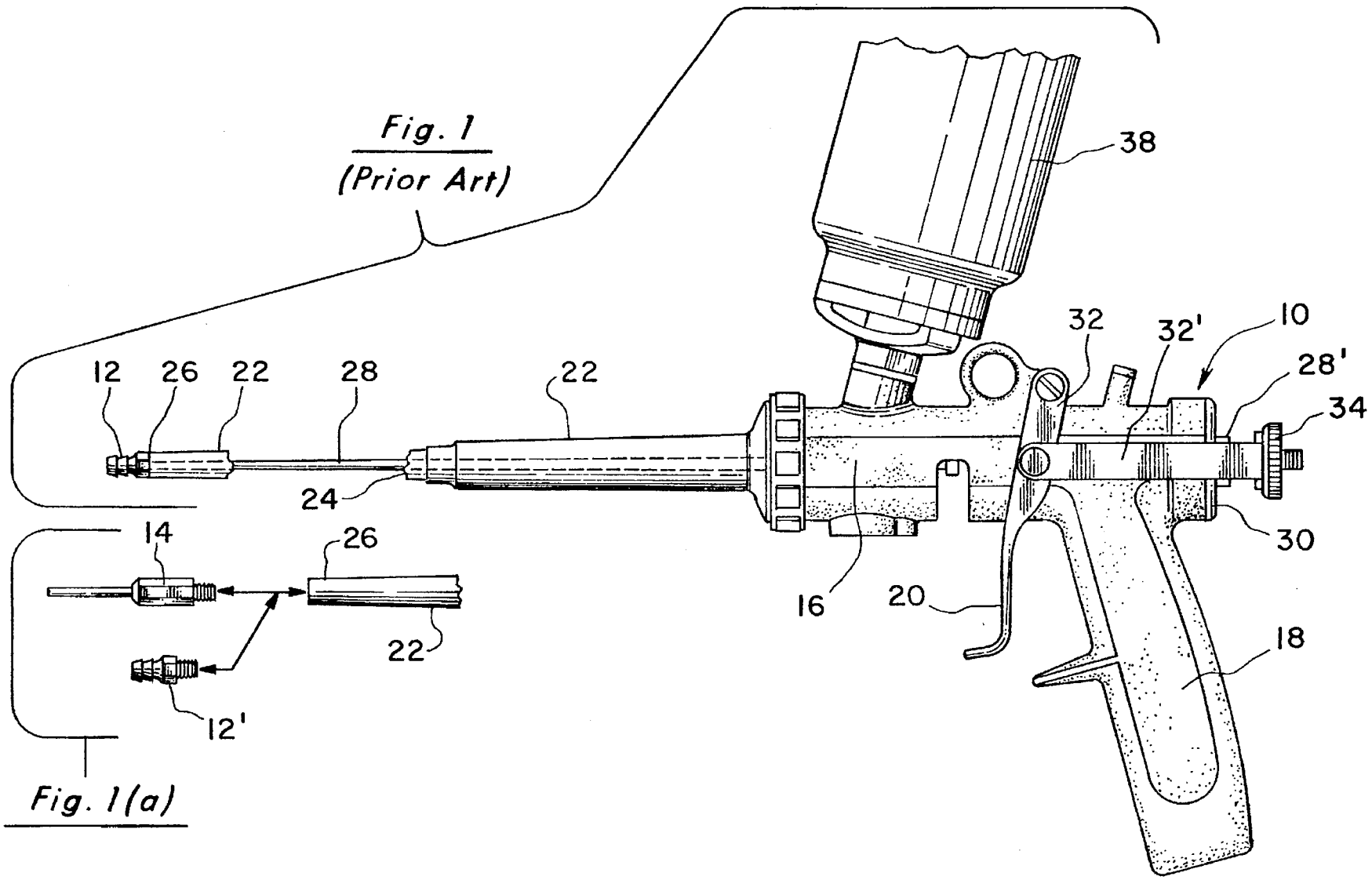
Fig. 1 (Prior Art)
FIG. 1 depicts a prior art foam gun equipped with a pressurized foam container and a prior art foam-dispensing nozzle. This prior art nozzle is shown positioned in the gun's barrel as well as detached from said barrel as indicated in FIG. 1(*a*).

FIG. 1, generally depicts a prior art foam-dispensing gun to which a foam tip gun assembly made according to this patent disclosure can be attached. A prior art nozzle 12 is shown attached to the prior art gun 10 as well as detached from said gun (i.e., it is shown as detached item 12'). FIG. 1(*a*) suggests how applicant's foam gun tip assembly 14 can be similarly attached to, and detached from, the same foam gun 10.

The foam gun's body 16 is provided with a pistol grip type handle 18 and a trigger 20. The foam gun 10 has a barrel 22 having a longitudinal bore 24 through which foam passes. The front end 26 of barrel 22 is adapted (e.g., by use of threads) to carry a prior art, foam-dispensing nozzle 12—or applicant's foam gun tip assembly 14. A needle valve rod 28 extends through virtually the entire length of the gun 10 from its rear end 28' to its nozzle 12. In cooperation with a needle valve chamber (not shown) in the nozzle 12, the needle valve rod 28 acts as the "valve" that controls foam flow from the nozzle to the desired work area. The rod 28 is moved under the action of the gun's trigger 20, and a spring (that is housed in the gun body 16 and hence not seen in FIG. 1), whose actions produce reciprocal motion of the needle valve rod 28 within the gun 10. The needle valve rod 28 is generally positioned coaxially within the barrel's bore 24 and gun body 16. The needle valve rod's rear end 28' projects through an opening (not shown) in the rear wall of the gun body 16. There, it engages with a trigger linkage mechanism 32 and 32' that is attached to the rear end 28' of needle valve rod 28. The trigger linkage mechanism is pivotally mounted to the top of the gun body 16 such that it is positioned in front of the pistol grip 18.

Aside from being attached to the trigger linkage mechanism 32 and 32', the rear end 28' of the needle valve rod 28 is also threadedly associated with a foam flow adjustment screw 34. This adjustment screw can "fine tune" the foam's flow rate and/or volume. A pressurized foam supply container 38 is shown mounted on top of the foam gun's body 16. The foam container 38 is in fluid communication with the nozzle 12 via the bore 24 of barrel 22. The bore 24 of said gun also may be tapered in order to create a venturi effect upon the foam in order to promote its flow through the barrel 22 and out of the nozzle 12.

Figure 8:
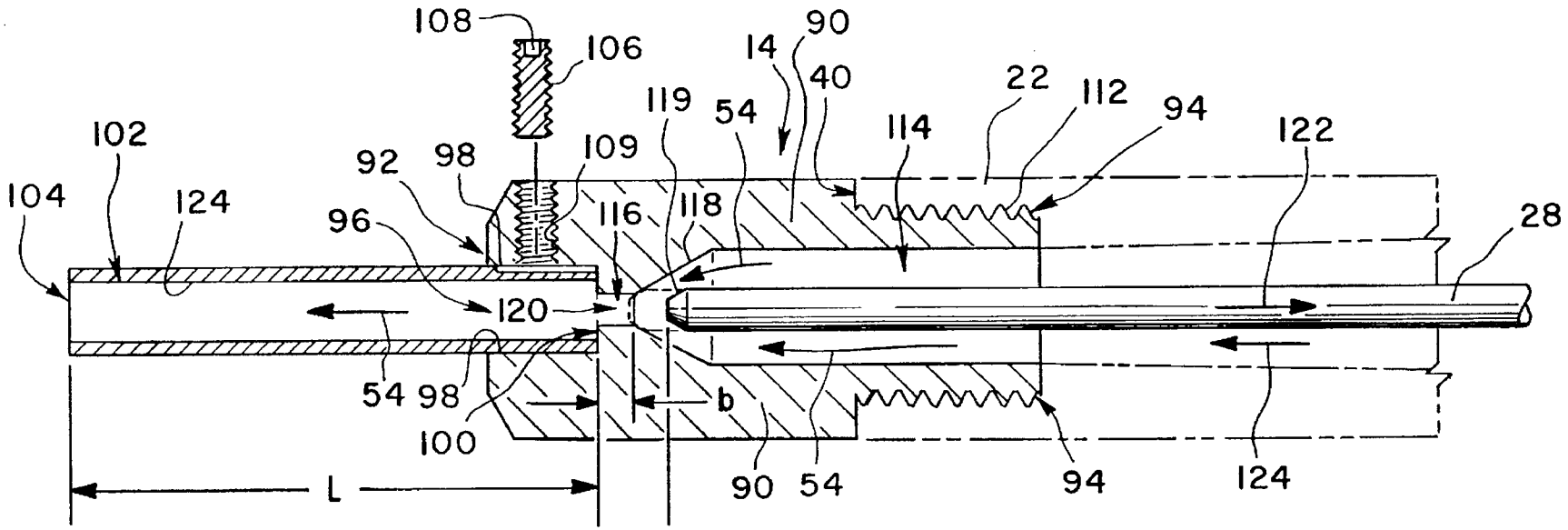
FIG. 8 is a cut-away view of a foam gun tip assembly made according to the teachings of this patent disclosure.

As is better depicted in FIG. 8 of this patent disclosure, the front end of such a needle valve rod 28 will have an outer diameter that is coincident with the inner diameter of a central, preferably cylindrical, chamber of the foam gun tip assemblies of this patent disclosure. As previously noted, a compression spring (not shown) is attached to the needle valve rod 28 (via a lock ring mechanism not shown) in the gun's body 16. In effect, the spring functions as a biasing means to urge the needle valve rod forward and into a hole in the central chamber of the herein described foam gun tip assembly 14. This mechanical arrangement also is more fully described in an ensuing discussion of FIG. 8 of this patent disclosure. In any case, pulling trigger 20 rearward toward the pistol grip 18, pulls the needle valve rod 28 rearwardly and thereby permits flow of foam through the barrel's bore 24 and out of the front end of the foam gun tip assembly 14. Conversely, releasing the trigger allows the spring attached to the needle valve rod 28 to force the front end of the needle valve rod forward and into the foam gun tip assembly's central chamber and thereby shutting off flow of the foam.

Figure 2:
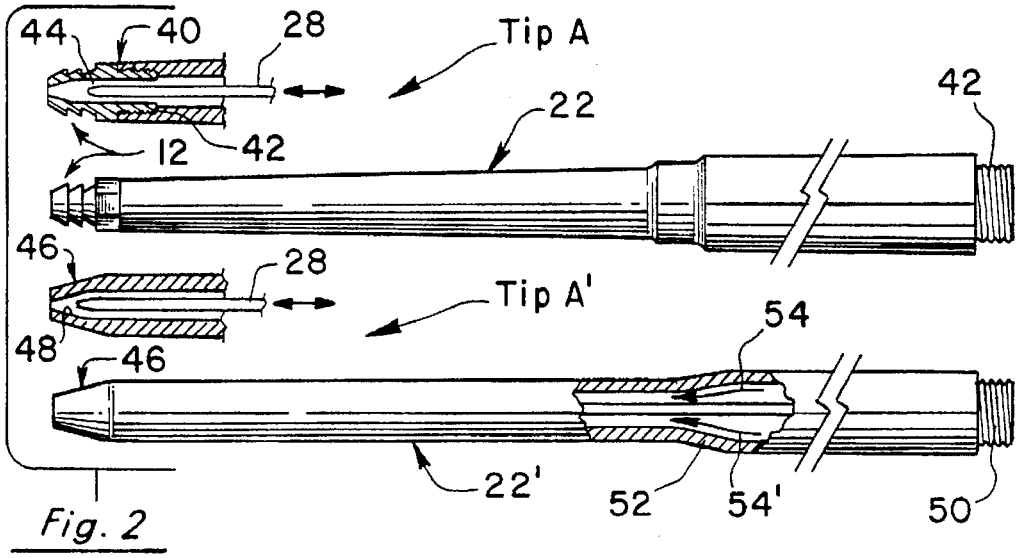
Fig. 2 (Prior Art)
FIG. 2 depicts two different kinds of barrel ends commonly found on many prior art foam guns.

FIG. 2 depicts cut away views of the two most common kinds of prior art barrels and tips found on commercially available foam guns such as the one shown in FIG. 1. Tip A provides the type of tip/nozzle arrangement illustrated in FIG. 1. It features a detachable, barbed nozzle 12 fastened to the front end 40 of barrel 22. Barrel 22 is shown in FIG. 2 provided with fastening means 42, such as threads, for mounting the barrel 22 to a foam gun (not shown). Nozzle 12 is shown in the cut away view of Tip A of FIG. 2 provided with a rear port opening 44 for reception of, reciprocally movable, needle valve rod 28.

Tip A' is shown in FIG. 2 with a truncated, conical front end 46. Tip A' also is shown provided with a needle valve rod—operated valve 48 that cooperates with needle valve rod 28 in a manner comparable to the operation of the valve associated with Tip A. Tip A' also is shown provided with coupling means 50 (e.g., threads) for attaching barrel 22' to a foam gun (not shown). Tip A' also illustrates how such a barrel 22' also may be provided with a restricted barrel bore 52 in order to impart a venturi effect to foam 54 (54') flowing through such a foam gun barrel.

Figure 3:
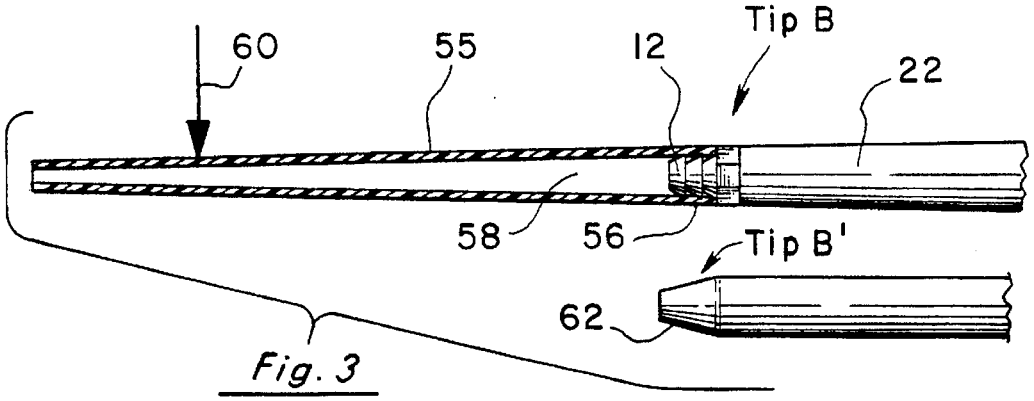
Fig. 3 (Prior Art)
FIG. 3 depicts the same two gun barrel ends shown in FIG. 2, but illustrates how Tip B can be provided with a prior art accessory tip.

FIG. 3 also depicts the two kinds of foam gun tips shown in FIG. 2. Tip B of FIG. 3, however, is also shown provided with a prior art, accessory tip 55. Such tips are typically made of a plastic material; hence they can be compression fitted over the nozzle's tip 12. Such nozzle tips usually have a barbed, and tapered, front end 56 such as that suggested in FIG. 3. Such tapered, barbed ends aid in achieving compression fits between these kinds of accessory tips and nozzles of this kind. Accessory tips of such design also are characterized by their relatively large inner volumes 58 (e.g., large, compared to the volume of the valve chamber of nozzle 12). In any case—owing to their elongated configuration—these kinds of accessory tips can reach otherwise inaccessible areas in need of foam caulking; but their relatively large inner volume 58 tends to reintroduce the "post-shutoff-drip" problem. That is to say that the foam remaining in the inside volume 58 of such an accessory tip—after the valve in nozzle 12 has been closed—will auto expand and produce some 4 to 8 inches of "excess" foam. Moreover, such "compression fit" accessory tips are subject to being "blown off" nozzles of this kind under the pressures needed to force foam through the gun. This tendency to come off is especially prevalent in accessory tips of this kind when they are subjected to lateral mechanical forces of the kind generally depicted by arrow 60. Under such circumstances, foam gun operators often find it necessary to hold and guide such compression-fitted accessory tips with one hand while operating the gun with the other. Again, this circumstance creates far greater operator fatigue compared to those caulking operations where the foam gun can be held and operated by one hand.

Tip B' of FIG. 3 is not shown provided with an accessory tip such as the one shown associated with Tip B because it has been found that such tips simply will not stay affixed to the smooth, truncated ends 62 of barrels of this design under the internal pressures applied to force foam out of such barrel tips and/or under those lateral mechanical forces (such as those depicted by arrow 60 shown with respect to Tip B) encountered during use of these accessory tips.

Figure 4:
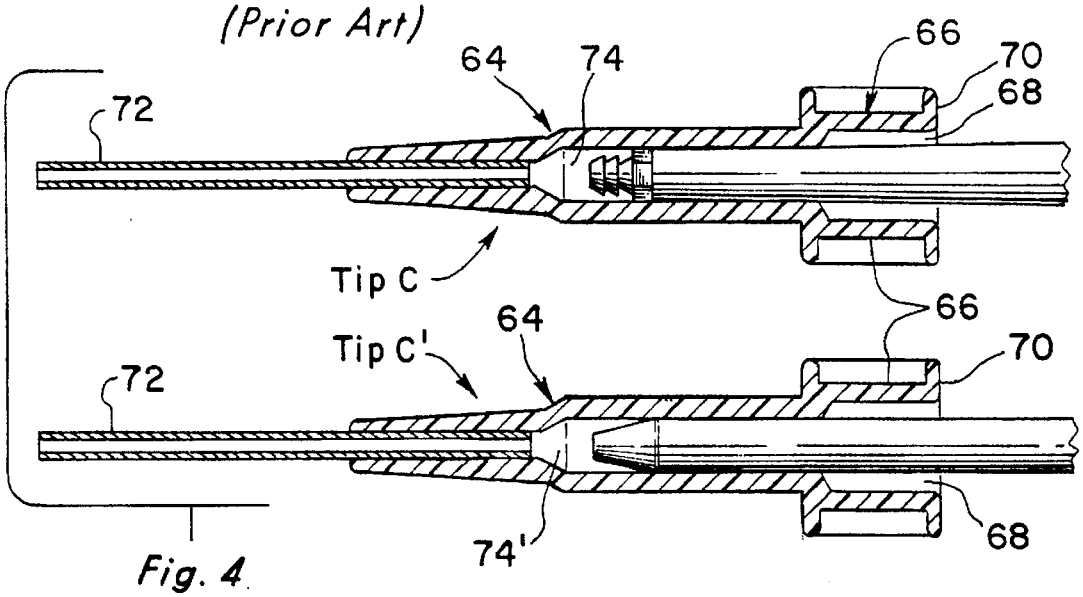
Fig. 4 (Prior Art)
FIG. 4 depicts the two gun barrel ends shown in FIG. 2 provided with another type of prior art accessory tip.

FIG. 4 shows each of the two barrel/nozzle ends of FIG. 1 provided with a second type of accessory tip 64 as shown in FIG. 4. Such tips also are "compression" fitted over the ends of the respective barrel ends as shown. These accessory tips 64 and 64' are further characterized by their possession of a finger grip region 66 that encompasses the rear portion of this second type of accessory tip. Such accessory tips 64 generally hold foam-dispensing pressures better than the accessory Tip B shown in FIG. 3, but such tips 64 still experience foam leakage 68 at their rear ends 70 in the manner generally depicted in FIG. 4. This second type of accessory tip also is usually characterized by having a thin, tubular front end 72. It is well suited for reaching into deep, otherwise inaccessible cracks. This second type of accessory is, however, specifically designed for two-handed operation. Hence, relatively greater operator fatigue is experienced with its use. Use of such accessory tips 64 also tends to create void spaces 74 (and 74') where foam can reside after the shut off valve is closed—and from whence post-shutoff-drip will emanate.

FIG. 5 depicts yet another type of prior art accessory tip 76 mounted on Tip D'. It features a sleeve 78 especially adapted for extending well beyond the truncated conical front end of foam gun barrels such as that depicted in FIG. 2 as Tip A'. Such accessory tips 76 also are characterized by having a long-nosed dispensing tube 80, that tends to create post-shutoff-drip.

FIG. 6 depicts two more accessory tips 82, and 84, that are each characterized by having relatively large tube bores i.e., 86 and 88 respectively. These tips, aside from leakage problems (as depicted by arrows 87 and 87' respectively), also tend to produce significant post-shutoff-drip.

Figure 7C:
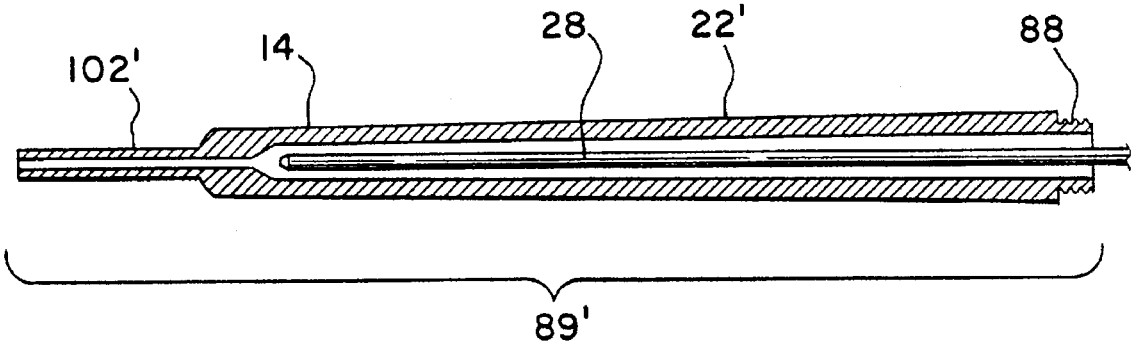
FIG. 7(*a*) shows a side view of Applicant's foam gun tip assembly detached from a foam gun barrel component.

FIGS. 7(*a*), 7(*b*) and 7(*c*) illustrate three versions of the foam gun tip assembly 14 of this patent disclosure. FIG. 7(*a*) shows tip F detached from the front end 86 of a foam gun barrel 22. Threaded attachment is preferred, but other means of attaching applicant's foam gun tip assembly to the barrel (e.g., compression fitting, "bayonet type" locking device etc.) also may be employed.

FIG. 7(*b*) shows a version of this invention wherein a foam gun tip assembly 14 is permanently attached to a barrel member 22'. It is further designated as Tip F' in FIG. 7(*b*). In this version, the tubular component 102' may be rendered "replaceable" in the same manner that tubular component 102 of Tip F shown in FIG. 7(*a*) is replaceable. That is to say that a foam gun tip assembly, having a chamber for receiving a replaceable tubular component 102', can be molded with the barrel member 22' and thereby make a unitary tip/barrel assembly 89 that can receive different tubular components 102 and be affixed to a foam gun by some appropriate affixing means 88 (e.g., a hollow, threaded tubular end, bayonet type locking means, gluing and other means of attachment known to the mechanical arts). The tubular component 102' also may be permanently molded to the front end of the housing 90 assembly 14. For example, in FIG. 7(*c*), bracketing symbol 89' is used to emphasize that a unitary, foam gun tip/foam conduit barrel assembly can include the tubular component 102'. Indeed, the entire foam gun tip/foam conduit barrel assembly, including the tubular component 102', can be molded (e.g., from a suitable "plastic" material) in a single unitary piece. In either case, however, the gun's needle valve rod 28 will project through the resulting tip/barrel apparatus in the manner generally depicted with respect to Tip F'.

FIG. 8 is a side, cut-away, view of a foam gun tip assembly 14 made according to the teachings of this patent disclosure. It can be replaceably affixed (e.g., by threads bayonet lock, compression fit and lock devices, etc.) to a foam gun barrel 22 or be made a part of a unitary, foam gun tip/foam conduit barrel assembly as noted in the previous discussion of FIG. 7. In either case, applicant's foam gun tip assembly 14 will have a housing 90 having a front end 92 and a rear end 94. Preferably, especially when the housing 90 (presented as a distinct part or as a region of a unitary, molded piece) is a "replaceable" component, the outer surface of the housing 90 will have a hexagonal configuration for receiving torque from a wrench. Again, in the first version of applicant's invention, the front end 92 of the housing 90 is provided with a forward receiving chamber 96 (that is preferably cylindrical in configuration) whose side walls 98 and rear wall 100 respectively serve to receive and abut a tubular component 102 that is inserted therein and acts as the foam gun tip assembly's foam-dispensing end 104. Preferably the tubular component 102 has an outside diameter that is only slightly smaller than the diameter of the forward receiving chamber 96. The tubular component 102 is preferably held in place in the forward receiving chamber 96 by any appropriate fastener or affixing means known to the mechanical arts such as a set screw 106 that projects through a hole 109 (preferably a threaded hole) in housing 90 and abuts against the tubular component 102—and thereby firmly holds said tubular component 102 in place during use of the foam gun 10. Preferably, such a set screw 106 will have a tightening means such as an Allen wrench receiver hole 108 for conveniently tightening and releasing the set screw 106 so that tubular components having different lengths and head configurations (see for example the flared head configuration 110 depicted in FIG. 9) may be readily and quickly mounted to, and dismounted from, the foam gun tip assembly 14. These tubular components also may be associated with the receiving chamber by other mechanical means such as compression fitting, threaded coupling, bayonet locks and the like. In other embodiments of applicant's foam gun tip assemblies, the tubular component 102 is permanently molded to, and made a unitary part of, the housing 90.

Referring again to the first version of applicant's invention, the rear end 94 of foam gun tip assembly 14 is shown in FIG. 8 attached to the front end 40 of a foam gun barrel 22. This attachment can be by any of several mechanical means known to the mechanical arts, but the most preferred of these is by means of a threaded coupling arrangement 112 created between the foam gun tip assembly 14 and the barrel 22 as illustrated in FIG. 8. In the second version(s) of this invention the foam gun tip assembly and the barrel can be molded into a unitary piece. In any case, foam 54 flowing through the bore 24 of foam gun barrel 22 flows into a rear chamber 114 in the housing component (or "region" of a unitary piece) 90. This rear chamber 114, in turn, leads to a central chamber 116 located between the rear chamber 114 and the forward receiving chamber 96. Preferably, the rear chamber 114 has a tapered, conical forward end 118 that leads into the central chamber 116. The central chamber 116 serves as the "valve" for the herein described foam gun tip assembly 14 in that when central chamber 116 is open at both ends, foam 54, under pressure provided by a foam container, will pass through a hole 120 defined by the central chamber 116 and be dispensed out of the front end 104 of tubular component 102.

This "valve" is closed by inserting the front end 119 of needle valve rod 28 into the hole 120 of central chamber 116. The depth of the hole 120 is depicted by the distance designation b in FIG. 8. Preferably the hole 120 defined by the central chamber 116 and the needle valve rod 28 each have round configurations. In any case, the needle valve rod 28 should have a diameter that is only slightly less than the diameter of the hole 120 in the central chamber 116. This circumstance allows the needle valve rod 28 to undergo reciprocal motion into, and out of, hole 120. As previously noted, such needle valve rods typically extend through virtually the entire length of the foam gun and are operated by the gun's trigger. As with prior art gun operations, when the foam gun's trigger is pulled backward the needle valve rod 28 is withdrawn from hole 120 in applicant's foam gun tip assembly and pulled rearward in the direction indicated by arrow 122 of FIG. 8. Thus, the central chamber 116 is opened, and foam 54 flows through the entire foam gun tip assembly 14.

Conversely, when the foam gun's trigger is released, the needle valve rod 28 is driven in the forward direction indicated by arrow 124 under the action of a spring (not shown) attached to the needle valve rod 28 in the foam gun's body. In effect the front end 119 of rod 28 completely fills hole 120 of the central chamber 116 and thereby prevents flow of foam 54 through the foam gun tip assembly 14. The rod's full forward position (generally denoted by the line FF in FIG. 8), preferably, will more or less, coincide with the surface defined by the rear wall 100 of the tube receiving chamber 96. The full rearward position (generally denoted by the line FR in FIG. 8) of the needle valve rod 28 is achieved when the gun's trigger is pulled as far back toward the gun's pistol grip as possible and thereby allowing foam to flow through the assembly 14. As shown in FIG. 8, pulling the trigger to its full rearward position should pull needle valve rod 28 to a full rearward position FR which is such that the rod 28 is completely removed from hole 120. This implies that the distance between the full forward position FF and the full rearward position FR of rod 28 is greater than the length (as shown by item "b" in FIG. 8) of the hole 120 in central chamber 116. The exact position of the full rearward position FR can be "adjusted" by means of the adjustment screw 34 shown in FIG. 1 that is attached to the rear end 28' of rod 28. This feature gives the operator the ability to "fine tune" the flow of foam.

Applicant has found that particularly good "post-shutoff-drip" results are obtained when the volume of the hole 120, of the central chamber 116 is relatively small (e.g., 0.05 cubic inch) and when this volume also is relatively small compared to the volume of the bore hole 124 of the tubular component 102. To this end, the volume of the bore hole 124 of such tubular components 102 generally should not exceed about 0.15 cubic inch, especially when they are used in conjunction with most foam guns now on the market. For example, applicant has found that particularly good foam dispensing, and post-shutoff-drip, results are obtained when the volume of the hole 120 of the central chamber 116 is less than about 35% of the volume of the bore hole 124 of tubular component 102. In order to achieve this volume limitation it is generally necessary to have the length of the tubular component 102 (as depicted by dimension L of FIG. 8) less than about 4 inches, and more preferably less than bout 3 inches, especially when the tubular component 102 has an inside bore diameter of about 0.05 inch to about 0.20 inch. Standard copper tubing (having a circular cross section) makes particularly good tubular components 102 for the practice of this invention in those cases where the tubular component 102 is held in place by set screw means such as the one depicted as item 106 in FIG. 8.

Figure 9:
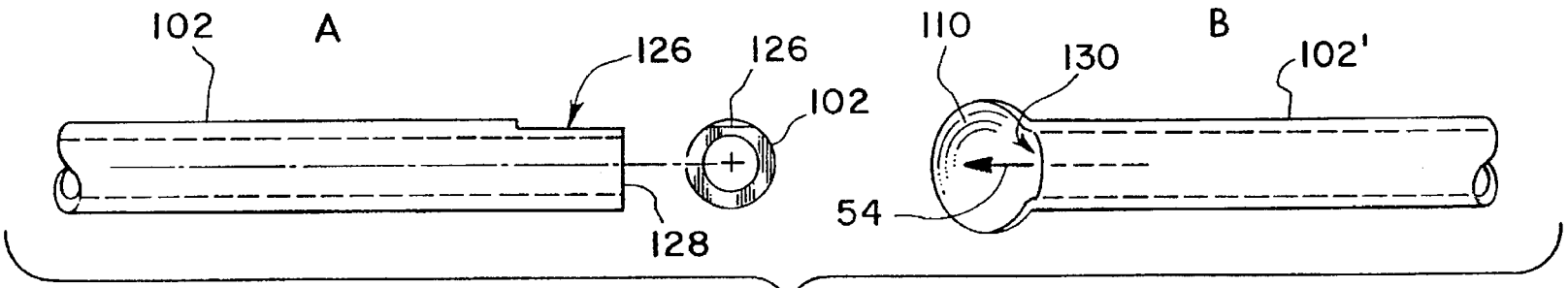
FIG. 9 shows various foam-dispensing tube configurations that can be associated with applicant's foam gun tip assembly.

FIG. 9 illustrates that the rear end 128 of a tubular component 102 also can be provided with a somewhat flattened region 126 in order that an affixing device, such as the set screw 106 shown in FIG. 8, can better abut against the tubular component 102 and, hence, more securely affix said tubular component 102 in the forward receiving chamber 96 of housing 90. The tubular component 102' depicted as item B in FIG. 9 is intended to show that the foam dispensing end 130 of any such tubular component used in the practice of this invention can be provided with different shaped foam dispensing ends, such as the flared head 110 shown in FIG. 9. Such head configurations may aid in laying foam beads requiring particular configurations or cured foam attributes.

Expressed in patent claim language, one version of applicant's invention—wherein the foam gun tip assembly is detachable from the front end of a foam gun barrel—will comprise: 1) a housing having a forward, nozzle end and a rearward, foam gun-connecting end and wherein said housing further comprises: (1) a forward chamber for receiving a foam-dispensing tube, (2) a detachable, foam-dispensing tube, (3) means for affixing the detachable, foam-dispensing tube in the forward chamber, (4) a central chamber for slidably receiving a needle valve rod that can be moved into and out of the central chamber by operation of a trigger device of a foam gun and thereby serving as a valve means for controlled dispensing of foam, (5) a rearward chamber that serves as a conduit for the needle valve rod and for foam being forced toward the nozzle end of the housing and (6) means (such as threads, bayonet locks, glue, etc.) for attaching the foam gun tip assembly to a foam gun.

The second version of applicant's invention—wherein the foam gun tip assembly is made a unitary part of a foam gun barrel (e.g., by being molded as a unitary piece), that in turn is attached to the body of a foam gun—will comprise: 1) a housing having a forward, nozzle end and a rearward, foam gun connecting end that includes a barrel component and which forms a unitary foam gun tip/foam conduit barrel assembly and wherein said housing further comprises: (1) a forward chamber for receiving a foam-dispensing tube, (2) a foam-dispensing tube, (3) means for affixing the foam-dispensing tube in the forward chamber, (4) a central chamber for slidably receiving a needle valve rod moved into and out of the central chamber by operation of a trigger device of a foam gun and thereby serving as a valve means for dispensing foam, (5) a rearward chamber that serves as a conduit for the needle valve rod and for foam being forced toward the nozzle end of the housing, (6) a foam conduit barrel component and (7) means for attaching the unitary foam gun tip/foam conduit barrel assembly to a foam gun body. This second variation may also be constructed by making the foam-dispensing tube a unitary part (e.g., by co-molded construction out of a plastic material) of the unitary, foam gun tip/foam conduit barrel assembly.

In order to compare the relative advantages and disadvantages of the various kinds of foam gun tip accessories shown in FIGS. 2 through 6 of this patent disclosure—relative to each other, and relative to those of the herein described foam gun tip assemblies—applicant has prepared a Table of Comparative Attributes of Foam Gun Tips. The numbers 1, 2, 3, . . . 33 appearing in said table refer to a list of comments concerning the relative advantages and disadvantages of the various foam gun tips listed in said table. That is to say that the numbers in the table correlate with the numbers associated with the list of Comments Regarding the Table that follows the Table of Comparative Attributes of Foam Gun Tips.

TABLE OF COMPARATIVE ATTRIBUTES OF FOAM GUN TIPS

| PROBLEMS ADDRESSED/ DEGREE OF SUCCESS | TIP A A' | TIP B B' | TIP C C' | TIP D D' | TIP E E' | TIP F F' |
|---|---|---|---|---|---|---|
| POST DRIP | | | | | | |
| LITTLE TO NONE | 1 | | | | | 5 |
| MODERATE | | | | | | |
| EXCESSIVE | | 2 | 3 | 3 | 4 | |

-continued

TABLE OF COMPARATIVE ATTRIBUTES OF FOAM GUN TIPS

| PROBLEMS ADDRESSED/ DEGREE OF SUCCESS | TIP A A' | TIP B B' | TIP C C' | TIP D D' | TIP E E' | TIP F F' |
|---|---|---|---|---|---|---|
| ENHANCE APPEARANCE OF FOAM | | | | | | |
| YES | | 7 | 7 | 7 | 7 | 7 |
| NO | 6 | | | | | |
| ATTACHMENT/LEAKAGE | | | | | | |
| NO PROBLEMS | 8 | | | | | 11 |
| SOME PROBLEMS | | | 10 | 10 | | |
| CONSTANT PROBLEMS | | 9 | | | 9 | |
| ABILITY TO WORK ON APPLICATION SURFACES | | | | | | |
| LARGE VOIDS | | | | | | |
| EXCELLENT | | | | | | 15 |
| GOOD | 12 | 13 | 13 | | 13 | |
| POOR | | | | 14 | | |
| SMALL VOIDS | | | | | | |
| EXCELLENT | | | | | | 19 |
| GOOD | | 17 | 17 | 17 | | |
| POOR | 16 | | | | 18 | |
| SURFACE CRACKS | | | | | | |
| EXCELLENT | | | | | | 23 |
| GOOD | | | | | | |
| POOR | 20 | 21 | 21 | 21 | 22 | |
| ACCESS TO WHERE GUN DOES NOT FIT | | | | | | |
| OPTIONS AVAILABLE | 24 | | | 26 | 26 | 27 |
| NO OPTIONS AVAILABLE | | 25 | 25 | | | |
| WEAR | | | | | | |
| GOOD | | | 30 | 30 | | 31 |
| POOR | 28 | 29 | | | 29 | |
| USE | | | | | | |
| AT ALL TIMES | 32 | | | | | 34 |
| FOR SPECIFIC APPLICATIONS ONLY | | 33 | 33 | 33 | 33 | |

COMMENTS REGARDING TABLE

1. As depicted in FIG. 2, when a foam gun's trigger is released its needle valve rod 28 seals off foam flow at the virtual end of the nozzles depicted with respect to Tip A and Tip A'. Hence, there is very little foam-containing volume in front of the respective valve chambers of these nozzles from whence foam can auto-expand. Thus, Tips A and A' achieve "positive shutoff" and create virtually no "post-shutoff-drip."

2. As shown in FIG. 3, Tip B has a tapered configuration and a relatively large volume 58 from whence foam can auto expand after the trigger is released and the gun's shutoff valve closed. Moreover, the tapered configuration of Tip B also tends to create a venturi effect on the foam in the tip and therefore tends to contribute to a more pronounced initial stage of post-shutoff-drip.

3. As illustrated in FIG. 4, the inside of Tips C and C' are tapered where the tips slide over the barrel in order to "compression fit" such tips to the barrel. This method of fitting tends to create a void space 74 (and 74') between the beginning of the tip's dispensing tube and the gun barrel's front end. This void space allows the foam to expand after the trigger is released and thereby creates considerable post-shutoff-drip. The relatively long length of the dispensing tube 72 also contributes to the post-shutoff-drip.

It also should be noted in passing that with respect to Tip D' of FIG. 5, a comparable void space 81 is created between the front of tip 46 of the barrel 22' and the rear of tube 80. Such a void space 81 will be larger than depicted in FIG. 5 if the accessory tip 76 is not fitted well back upon the tip 46 and barrel 22' in the manner suggested in FIG. 5. In any case void space 81, whatever its size, also contributes to undesired "post-shutoff-drip."

4. The accessory Tips E and E' depicted in FIG. 6 tend to be "blown off" the barrel under foam dispensing pressures. The inside volumes 86 and 88 respectively of Tips E and E' are relatively large; hence, a great deal of post-shutoff-drip occurs with their use.

5. As illustrated in FIG. 8, the length of the tubular component 102 of applicant's gun tip assembly, in conjunction with the relatively small volume of space in its central chamber 116, creates a "balanced" approach to the various problems encountered in this art in that this balanced approach allows only modest amounts of unexpanded foam in tubular component 102 and in hole 120 to expand after the trigger is released (e.g., this arrangement produces about one quarter to one half inches of post-shutoff-drip using most tubular components, and especially those having a length L less than about 2 inches), but "compensates" for this minimal post-shutoff-drip by providing a great deal of versatility of application, ease of operation and protection against wear—compared to some of, or all of, the prior art accessory Tips A, A', B, C, C', D', E and E'.

6. Foam released from Tips A and A' tends to have a lot of small bubbles in its surface, especially if there is not adequate moisture in the atmosphere or on the application surface to quickly cure the foam. Foam laid under such conditions will develop bubbles that will "pop" and cause gaps in the foam.

7. "Drag" placed on flowing foam by the walls of large volume tubes such Tip B of FIG. 3, Tips C and C' of FIG. 4, Tip D' of FIG. 5, Tips E and E' of FIG. 6—as well as applicant's foam gun tip assembly—all have a beneficial affect on the density of the foam being dispensed so that a more desirable, thicker and smoother skin is imparted to the resulting cured foam. It should also be noted in passing that if there is not adequate moisture in the atmosphere (or on the application surface) to cure certain foams, (such as urethane-based foams), laid by certain nozzle tips such as Tips B through F, the cured bead of foam turns out better than foam laid by other kinds of tips (e.g., Tip A) due to the increased density and thicker skin provided by the more elongated bodies of Tips B through F'.

8. Tips of the kind shown as Tip A in FIG. 2 are mechanically fastened (by threaded coupling) to their barrel. Consequently, there are rarely problems with their working loose because of frictional forces created between such tips and the application surface during foam laying operations.

9. Plastic tips of the type shown as Tip B of FIG. 3 and Tips E and E' of FIG. 6 tend to pop off their barrel with just a little lateral pressure being applied between such tips and the application surface. It is both "frustrating" and time consuming to clean uncured foam from such discharged accessory tips; it also is messy to remount them since such blown off tip usually have uncured foam all over them.

10. Accessory Tips C, C' and D' stay on foam gun barrels reasonably well, but still become "pinched" in small cracks and hence, pull off the gun barrel with which they are associated. Moreover, they too will leak foam, especially in the regions denoted by item 68 in FIG. 4.

11. Applicant's accessory Tips F and F' are mechanically fastened (e.g., by threaded coupling bayonet locks, etc., or by unitary molding of the foam gun tip assembly and barrel components) to their respective barrels. Consequently, there is rarely a problem with these tips working loose due to friction between applicant's tips and a working surface. Similarly, there is rarely a problem with applicant's tubular components 102 getting "pinched" in small voids and then pulling off the rest of the foam gun tip assembly when it is withdrawn from such a pinched engagement.

12. If the gun's barrel will fit, to a desired depth, into a given crack, hole, etc., no problems are encountered in using Tips A and A'. However, foam dispensed from such tips does tend to have an undesirable "bubbly" surface compared to foam beads created by more extended Tips B through F.

13. Tip types B, C, C', E and E' are typically not used to fill large void spaces. They work about as well as Tip A, but they often take more time to align with, and fill up, a given void space. Moreover, the these tips usually require the use of two hands.

14. The diameter of Tip D' of FIG. 5 is small, hence, it takes too long for this kind of tip to fill larger void spaces.

15. Applicant's tubular component 102 is more "rugged" than the compression-fitted plastic tips, hence they can be more roughly aligned with, and inserted into, a given hole, crack, etc., and then quickly fill it. Its somewhat elongated configuration also enhances the resulting foam bead's surface qualities.

16. Accessory Tip A will not fit into narrow void spaces. Trying to shoot foam into narrow voids from their surface openings often results in foam getting on the face of studs. Consequently, the resulting "excess" cured foam must be laboriously trimmed before drywall or interior trim can be put over such areas.

17. Tip types B, C, C' and D' generally will go into most void spaces created by modern construction practices, but they tend to create significant post-shutoff-drip that, in turn, creates a great deal of cured foam that must be trimmed.

18. The tube bores of Tips E and E' are often too large to fit into many of the smaller voids encountered in modern construction practices.

19. The outside diameter of the tubular component 102 of applicant's foam gun tip assembly fits into most of the smaller voids encountered in modern construction practices. Moreover, they create very modest amounts of post-shutoff-drip.

20. Foam beads laid by Tip A are difficult to get small enough so that they will not interfere with subsequent installation of drywall or wood trim.

21. Tip types B, C, C' and D' have one of the same basic problems noted with regard to comment 17, namely that as the operator comes to the end of a bead being laid by these tips, post-shutoff-drip occurs and causes a need to laboriously trim excess cured foam.

22. Due to the size of the bores of Tips E and E', post-shutoff-drip is a very significant problem with their use—and many attendant foam trimming requirements must be met.

23. With applicant's Tips F and F', even a relatively inexperienced operator can shoot small thin beads and experience very little post-shutoff-drip. Moreover, these tips stay securely affixed to their barrels as they are dragged across rough surfaces.

24. Nozzle Tip A can be readily used in conjunction with accessory Tips D', E and E'.

25. Tips A, A', B, C and C' are not able to get into deep, tight areas where the diameter of the gun barrel itself will prevent penetration.

26. Tips D', E and E' can be easily bent; they also have satisfactory length to get into many commonly encountered "hard to reach" areas in need of foam caulking.

27. Applicant's tubular component 102 can be easily removed from the foam gun tip accessory's body and any length of new tubular component 102 can be installed, and even bent to fit into virtually any crack, hole, etc.

28. Foam dispensing tips of the Tip A variety wear out as they are dragged across rough application surfaces (wood, metal, concrete). If such tips are not replaced at an early stage of such wear, the needle valve rod residing in them also will wear down at the point where it no longer "seats" to create the valve; consequently the Tip A nozzles have to be frequently replaced.

29. The plastic materials from which Tips B, E and E' are made wear down very quickly and have to be frequently replaced.

30. The copper, dispensing tubes of Tips C, C' and D' wear slowly and have a fairly long working life.

31. The main body, and valve portions of applicant's foam gun tip assemblies receive very little external wear. Their tubular components 102 do wear down, but they can be readily replaced, at nominal costs.

32. Tips A and A' depicted in FIG. 2 can be used, with varying degrees of success, for most foam application jobs.

33. Tip types B, C, C', D', E and E' are usually used only for very specific applications.

34. The main body and valve portions of applicant's foam gun assemblies can be used at all times during an overall job—but with various different tubular components (e.g., 102 and 102') that are especially useful in different situations.

Thus, while applicant's hereindescribed foam gun tip assemblies have been described by their mechanical features, and by comparison with several prior art foam dispensing tips, it is to be understood that this invention should not be limited to the features so illustrated, but rather by the scope of the following claims.

Thus, having disclosed this invention, I claim:

1. A foam gun tip assembly comprising:

1) a housing having a forward, nozzle end and a rearward, foam gun barrel-connecting end and wherein said housing further comprises: (1) a forward chamber for receiving a detachable foam-dispensing tube, (2) said detachable foam-dispensing tube, (3) means for affixing the detachable foam-dispensing tube in the forward chamber, (4) a central chamber for slidably receiving a needle valve rod moved into and out of said central chamber by operation of a trigger device of a foam gun and thereby serving as a valve means for dispensing foam, (5) a rearward chamber that serves as a conduit for the needle valve rod and for foam being forced toward the nozzle end of the housing and wherein said rearward chamber has a forward end that has a truncated cone configuration that serves to constrict flow of foam being forced forward toward the forward, nozzle end of the housing and into the central chamber when said central chamber is not occupied by the needle valve rod and (6) means for attaching the foam gun tip assembly to a barrel component of a foam gun.

2. The foam gun tip assembly of claim 1 wherein the housing has a hexagonal outer configuration for receiving torque from a wrench.

3. The foam gun tip assembly of claim 1 wherein the forward, nozzle end of the housing has a threaded hole for receiving a threaded set screw used to abut against, and thereby affix, the foam-dispensing tube within the forward chamber.

4. The foam gun tip assembly of claim 1 wherein the rearward, foam gun connecting end of the housing is provided with threads for threaded engagement with a threaded front end of a barrel component.

5. The foam gun tip assembly of claim 1 wherein the foam dispensing tube is copper tubing having a circular cross section.

6. The foam gun tip assembly of claim 1 wherein the foam-dispensing tube is less than about 4 inches in length.

7. The foam gun tip assembly of claim 1 wherein a void space defined by the volume of the central chamber is no more than about 35% of the volume defined by the inside bore of the foam-dispensing tube.

8. The foam gun tip assembly of claim 1 wherein the foam-dispensing tube has a flared end.

9. A unitary, foam gun tip/foam conduit barrel assembly comprising:

1) a housing having a forward, nozzle end and a rearward, foam gun connecting end which forms a forward region of a unitary, foam gun tip/foam conduit barrel assembly and wherein said housing further comprises: (1) a forward chamber for receiving a foam-dispensing tube, (2) a foam-dispensing tube, (3) means for affixing the foam-dispensing tube in the forward chamber, (4) a central chamber for slidably receiving a needle valve rod moved into and out of the central chamber by operation of a trigger device of a foam gun and thereby serving as a valve means for controlled dispensing of foam, (3) a rearward chamber that serves as a conduit for the needle rod and for foam being forced toward the nozzle end of the housing and wherein said rearward chamber has a forward end that has a truncated cone configuration that serves to constrict flow of foam being forced forward toward the forward, nozzle end of the housing and into the central chamber when said nozzle chamber is not occupied by the needle valve rod, (4) a foam conduit barrel component that forms a rearward region of the unitary, foam gun tip/foam conduit barrel assembly and (5) means for attaching the unitary, foam gun tip/foam conduit barrel assembly to a foam gun.

10. The foam gun tip assembly of claim 9 wherein the forward, nozzle end of the housing has a threaded hole for receiving a threaded set screw used to abut against, and thereby affix, the foam-dispensing tube within the forward chamber.

11. The foam gun tip assembly of claim 9 wherein the foam-dispensing tube has a length that is less than about four inches.

12. The foam gun tip assembly of claim 9 wherein a void space defined by the volume of the central chamber is no more than about 35% of a volume defined by the inside bore of the foam dispensing tube.

13. The foam gun tip assembly of claim 9 wherein said assembly further comprises a detachably mounted foam-dispensing tube.

14. The foam gun tip assembly of claim 9 that further comprises a foam-dispensing tube that is molded with the forward, nozzle end of the housing.

* * * * *